US008506416B1

(12) United States Patent
Radel, Sr. et al.

(10) Patent No.: US 8,506,416 B1
(45) Date of Patent: Aug. 13, 2013

(54) ADJUSTABLE GOLF SURFACE SYSTEM

(76) Inventors: James D. Radel, Sr., Fort Pierce, FL (US); Joshua D. Radel, Lyons, OH (US)

( * ) Notice: Subject to any disclaimer, the term of this patent is extended or adjusted under 35 U.S.C. 154(b) by 0 days.

(21) Appl. No.: 13/433,803

(22) Filed: Mar. 29, 2012

(51) Int. Cl.
*A63B 69/36* (2006.01)

(52) U.S. Cl.
USPC ..... 473/279; 473/278

(58) Field of Classification Search
USPC ..... 473/150, 157, 160, 278, 279
See application file for complete search history.

(56) References Cited

U.S. PATENT DOCUMENTS

D267,739 S 1/1983 Hughes
5,005,837 A * 4/1991 Urra Martinez ..... 473/279
5,944,615 A * 8/1999 Lee ..... 473/279
6,659,881 B2 * 12/2003 Lee ..... 473/279
6,921,342 B2 7/2005 Jong
7,758,444 B2 7/2010 Crossley
7,938,734 B2 * 5/2011 Dsouza ..... 473/279
2004/0110570 A1 * 6/2004 Hutchon et al. ..... 473/161
2007/0191128 A1 8/2007 Tirol
2008/0274817 A1 11/2008 Gibbons
2010/0056289 A1 3/2010 Zhou et al.

* cited by examiner

*Primary Examiner* — Nini Legesse

(57) ABSTRACT

An adjustable golf surface system having first and second platforms pivotally connected via a hinge wherein a golf surface is on the top surface of the first platform, the platforms can rotate about a base and base stud in a clockwise and counterclockwise direction. A lifting mechanism operated by a jackscrew allows the first platform to pivot upwardly with respect to the second platform.

5 Claims, 5 Drawing Sheets

(In-use View)

(ISO View)

(Bottom View)

(Side View)

(Back View)

(Cross-sectional View)

(In-use View)

(Detail View of Base and bearing Flange)

ADJUSTABLE GOLF SURFACE SYSTEM

FIELD OF THE INVENTION

The present invention is directed to a golf accessory, more particularly to an adjustable surface for hitting golf balls.

BACKGROUND OF THE INVENTION

Many golfers find themselves needing to practice uphill, side hill, and downhill shots. The present invention features an adjustable golf surface system for providing a user endless ball lies to practice hitting.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features an adjustable golf surface system. In some embodiments, the system comprises a first platform having a first side, a second side opposite the first side, a third side, and a fourth side, and a second platform having a first side, a second side opposite the first side, a third side, and a fourth side the first platform is positioned over a top surface of the second platform and a hinge pivotally connects the second side of the first platform to the second side of the second platform, wherein a golf surface is disposed on a top surface of the first platform, wherein a hollow base frame is fixedly attached in the second platform; a base and a base stud extending upwardly from the base, wherein a bearing is rotatably positioned on the base stud, a flange extends outwardly from the bearing, and at least two springs connect the flange to the base frame; a jackscrew having a first end and a second end, the first end protrudes through the first side of the second platform and the second end is anchored to either the second side of the second platform or to the base frame, a nut is rotatably disposed on the jackscrew; a first sliding track disposed in an inner surface of the third side of the first platform and a second sliding track disposed in an inner surface of the third side of the second platform; a first height adjustment bar having a first end and a second end, and a second height adjustment bar having a first end and a second end, the second end of the first height adjustment bar is pivotally attached to the first end of the second height adjustment bar via a first joint, the first end of the first height adjustment bar is pivotally attached to the inner surface of the third side of the second platform wherein the first end of the first height adjustment bar is positioned closer to the first side of the second platform than is the second sliding track, the first joint is slidably disposed in the first sliding track, and the second end of the second height adjustment bar is slidably disposed in the second sliding track; a third siding track disposed in an inner surface of the fourth side of the first platform and a fourth sliding track disposed in an inner surface of the fourth side of the second platform; a third height adjustment bar having a first end and a second end, and a fourth height adjustment bar having a first end and a second end, the second end of the third height adjustment bar is pivotally attached to the first end of the fourth height adjustment bar via a second joint, the first end of the third height adjustment bar is pivotally attached to the inner surface of the fourth side of the second platform wherein the first end of the third height adjustment bar is positioned closer to the first side of the second platform than is the fourth sliding track, the second joint is slidably disposed in the third sliding track, and the second end of the fourth height adjustment bar is slidably disposed in the fourth sliding track; a first spring line having a first end attached to the nut and a second end attached to the second end of the second height adjustment bar, and a second spring line having a first end attached to the nut and a second end attached to the second end of the fourth height adjustment bar; a first return spring anchored to an inner surface of the second side of the second platform near the third side of the second platform, and a second return spring anchored to the inner surface of the second side of the platform near the fourth side o the second platform; and a third spring line connecting the first return spring to the second end of the second height adjustment bar and a fourth spring line connecting the second return spring to the second end of the fourth height adjustment bar, the return springs bias to pull the second ends of the second height adjustment bar and fourth height adjustment bar toward the second end of the second platform; wherein when the jackscrew is rotated in a first direction, the nut moves toward the first side of the second platform and the nut pulls the first spring line and third spring line, which causes the second end of the second height adjustment bar to slide within the second sliding track toward the first end of the first height adjustment bar and the second end of the fourth height adjustment bar to slide within the fourth sliding track toward the first end of the third height adjustment bar causing the first joint to slide within the first sliding track and push upwardly on the first platform and the second joint to slide within the third sliding track and push upwardly on the first platform; wherein when the jackscrew is rotated in a second direction, the nut moves away from the first side of the second platform and tension is released from the first spring line and third spring line, and the first return spring pulls the second end of the second height adjustment bar toward the first return spring and the second return spring pulls the second end of the fourth height adjustment bar toward the second return spring, and the first joint slides within the first sliding track and the second joint slides within the third sliding track, releasing upward pressure on the first platform, effectively lowering the height of the first side of the first platform.

In some embodiments, the platforms can spin in a first direction and a second direction about the base stud. In some embodiments, the system further comprises a hand crank removably attached to the first end of the jackscrew. In some embodiments, the first spring line is fed through at least one pulley. In some embodiments, the second spring line is fed through at least one pulley.

DESCRIPTION OF PREFERRED EMBODIMENTS

Figure 1:
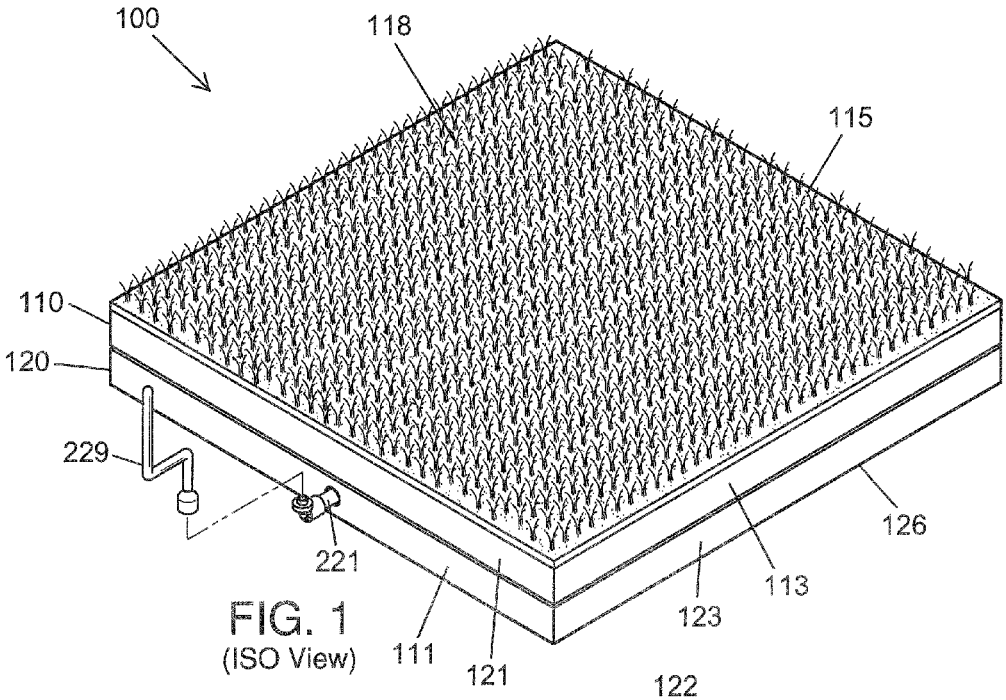
FIG. 1 is a perspective view of the system of the present invention.
Figure 2:
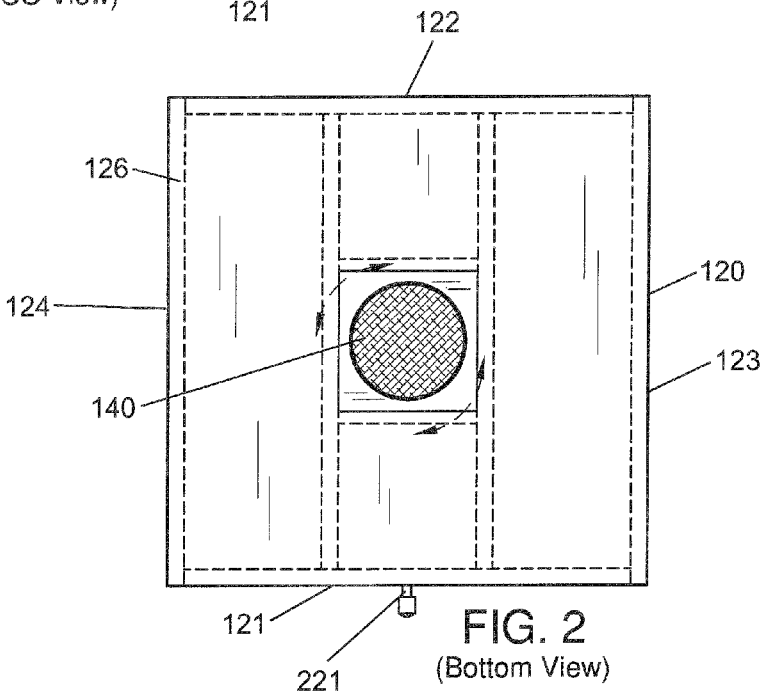
FIG. 2 is a bottom view of the system of the present invention.
Figure 3:
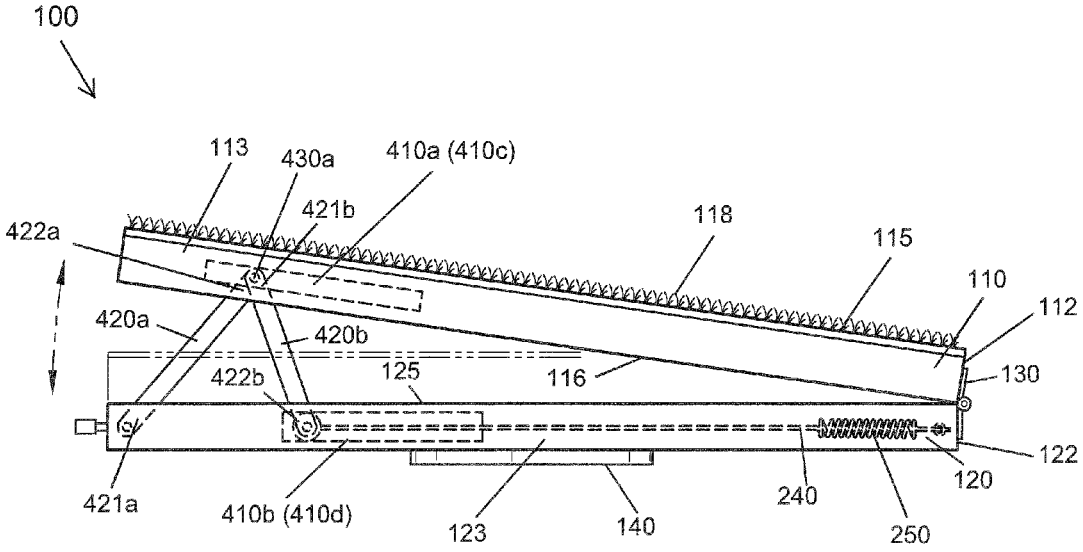
FIG. 3 is a side view of the system of the present invention.
Figure 4:
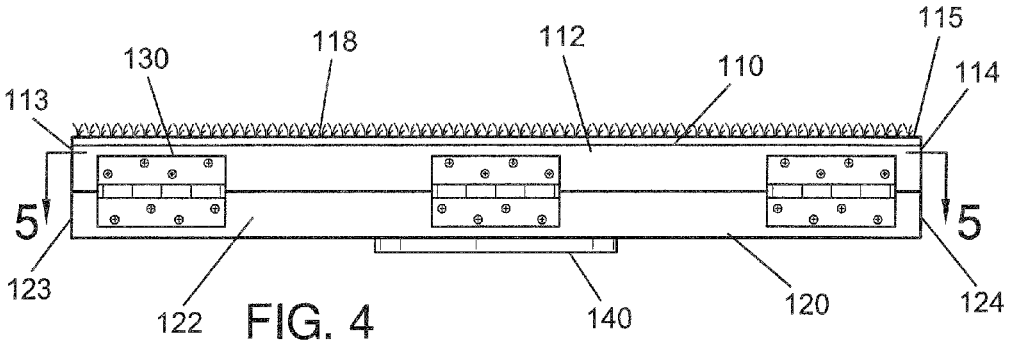
FIG. 4 is a back view of the system of the present invention.

Referring now to FIGS. 1-7, the present invention features an adjustable golf surface system 100 for providing a user endless ball lies to practice hitting. The system 100 comprises a first platform 110 and a second platform 120 pivotally connected via a hinge 130 such that the bottom surface 116 of the first platform 110 is positioned over or atop the top surface 125 of the second platform 120. The first platform 110 can pivot in a first direction towards the second platform 120 and a second direction away from the second platform 120. For reference to the figures, the first platform 110 has a first side 111, a second side 112 opposite the first side 111, a third side 113, and a fourth side 114 opposite the third side 113. The second platform 120 has a first side 121, a second side 122 opposite the first side 121, a third side 123, and, a fourth side 124 opposite the third side 123 (the first side 121 of the second platform 120 is aligned with the first side 111 of the first platform 110, the second side 122 of the second platform 120 is aligned with the second side 112 of the first platform 110, etc.). The hinge is disposed on the second sides 112, 122 of the platforms 110, 120.

Disposed on the top surface 115 of the first platform 110 is a golf surface 118. Golf surfaces are well known to one of ordinary skill in the art. For example, the golf surface may comprise synthetic turf, grass, or the like.

Figure 7:
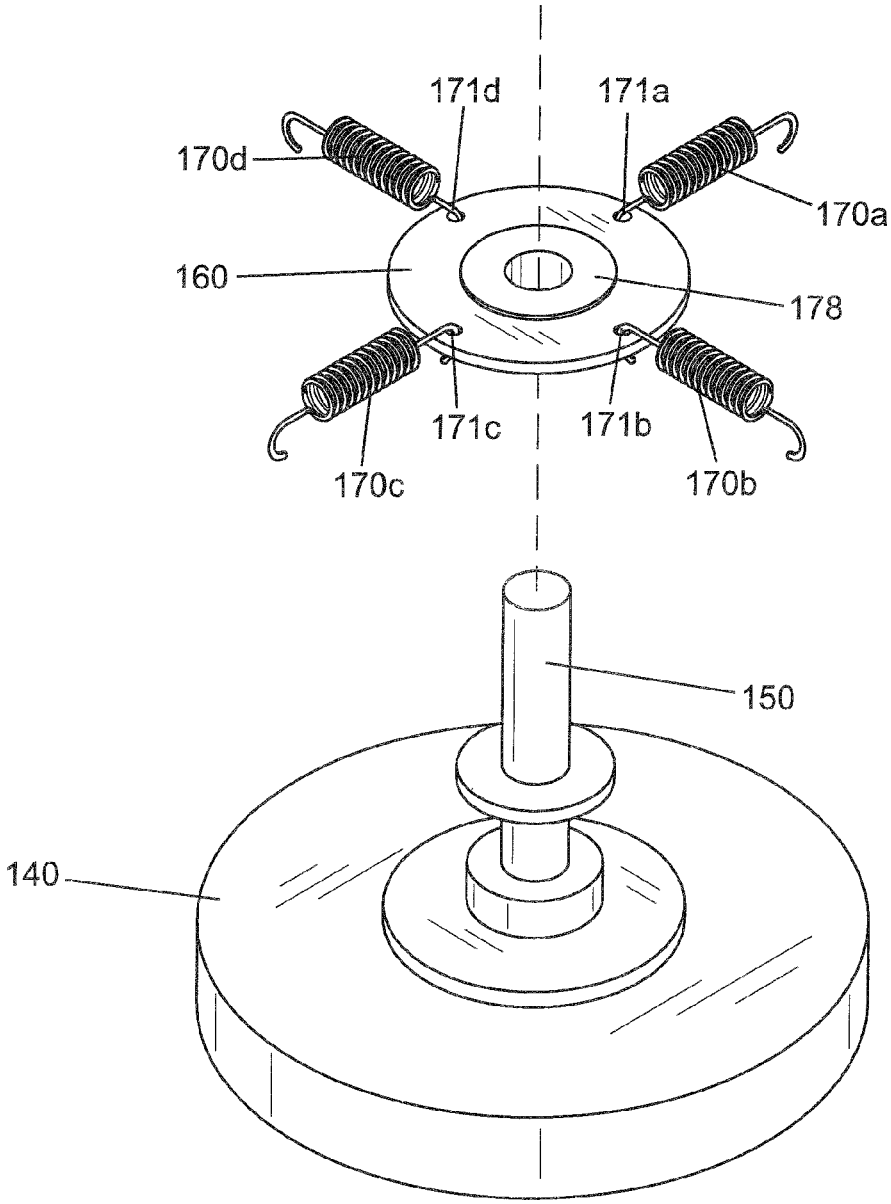
FIG. 7 is a detailed view of the base and bearing flange of the system of the present invention.

As shown in FIG. 7, the system 100 further comprises a base 140 having a base stud 150 (e.g., shaft) extending upwardly from the base 140 (e.g., from the center portion of the base 140). The base 140 is positioned under the bottom surface 126 of the second platform 120 (e.g., see FIG. 2, FIG. 3, FIG. 4).

The system 100 further comprises a bearing 178 positioned (e.g., rotatably disposed) on the base stud 150. The bearing 178 can rotate in a first direction and a second direction, e.g., clockwise, counterclockwise, about the base stud 150 (e.g., effectively allowing the platforms to rotate). The bearing 178 may be positioned a distance above the base 140 (e.g., a stopper may be disposed on the base stud 150, which prevents the bearing 178 from moving all the way down to the base 140). Bearings are well known to one of ordinary skill in the art. In some embodiments, the bearing is generally circular with a hollow center (e.g., a ring). A flange 160 extends outwardly from the bearing 178 (e.g., see FIG. 7). In some embodiments, the flange 160 is generally circular or ring-shaped.

One or more springs 170 are disposed on the flange 160. For example, a first spring 170*a* (e.g., the first end 171*a* of a first spring 170*a*) is disposed on the flange 160, a second spring 170*b* (e.g., the first end 171*b* of a second spring 170*b*) is disposed on the flange 160, and a third spring 170*c* (e.g., the first end 171*c* of a third spring 170*c*) is disposed on the flange 160. In some embodiments, a fourth spring 170*d* (e.g., the first end 171*d* of a fourth spring 170*d*) is disposed on the flange 160. The springs 170 may be arranged symmetrically or asymmetrically around the flange 160. The springs extend outwardly from the flange 160 (e.g., see FIG. 7).

Figure 5:
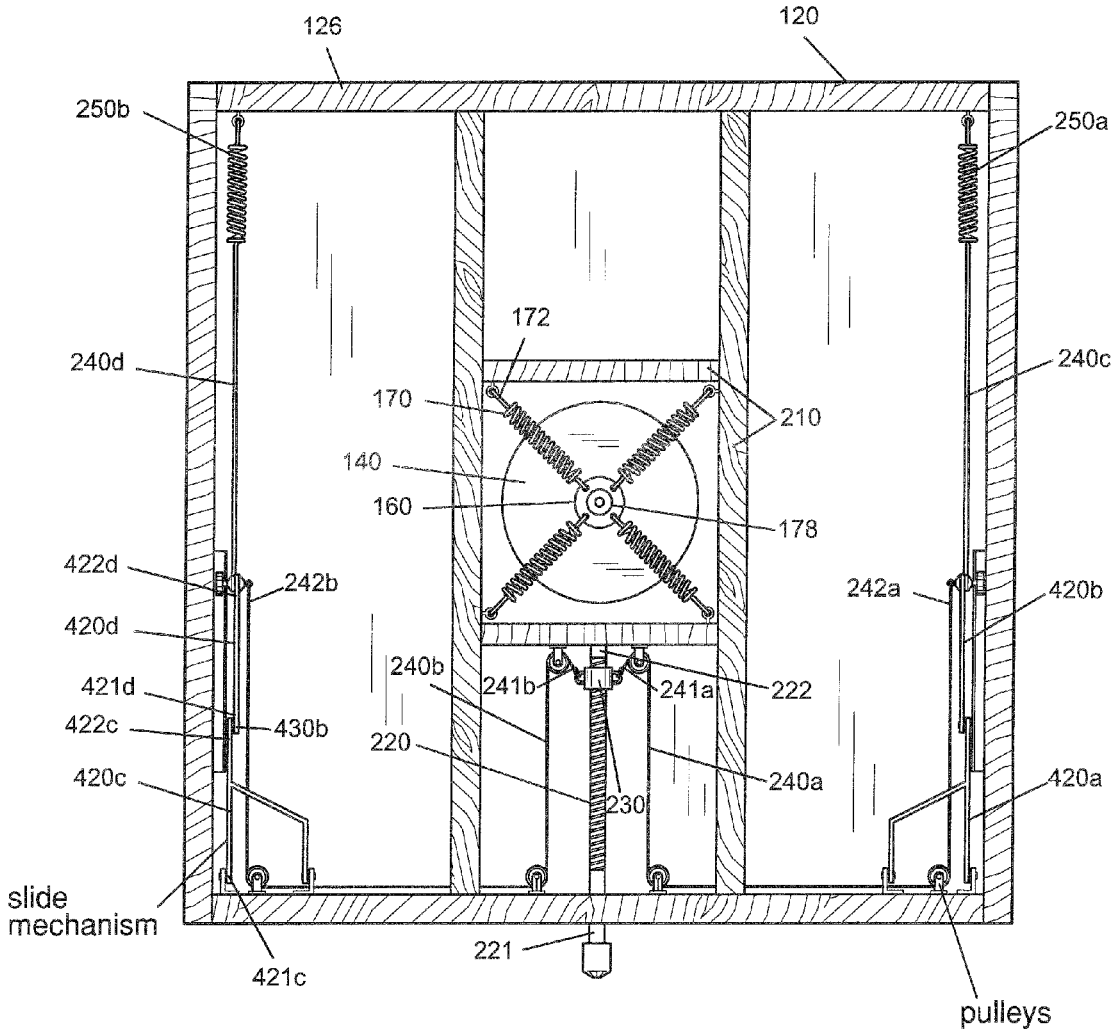
FIG. 5 is a cross sectional view of the system of FIG. 4.
Figure 6:
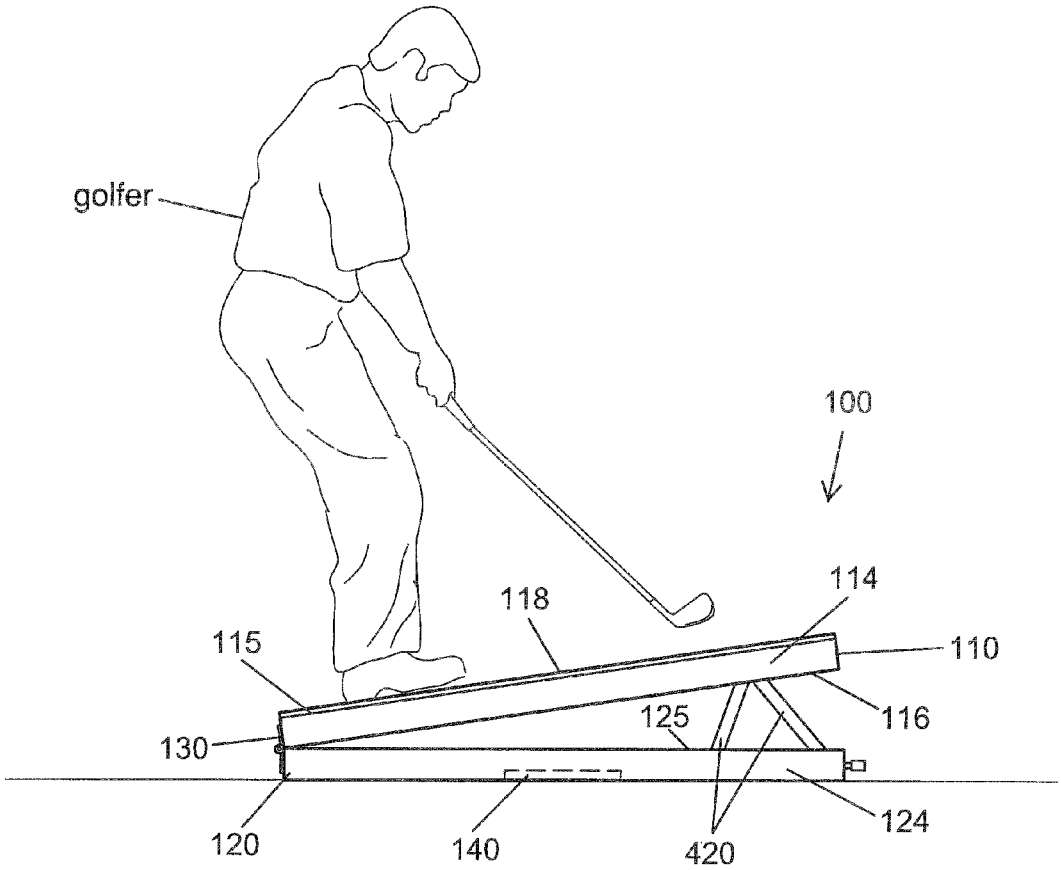
FIG. 6 is an in-use view of the system of the present invention.

The second ends 172 of each spring 170 attach to the second platform 120. In some embodiments, as shown in FIG. 5, a base frame 210 is fixedly disposed in the second platform 120, e.g., in the center area of the second platform 120. The base frame 210 surrounds the base 140 and base stud 150. The second ends 172 of each spring 170 attach to the base frame 210 (e.g., the inner surface of the base frame 210).

The platforms 110, 120 can spin freely about the base 140 (e.g., when no weight is placed on the platforms 110, 120). In some embodiments, the second platform 120 is raised a distance above the ground surface when no weight is placed on the platforms 110, 120 (e.g., no one is standing on the first platform 110). In some embodiments, when weight is placed on the platforms 110, 120, the platforms 110, 120 settle to the ground (and cannot be spun about the base 140 and base stud 150).

The system 100 further comprises a jackscrew 220 having a first end 221 and a second end 222. The first end 221 protrudes from the first side 121 of the second platform 120, and the second end 222 is anchored to the second platform 120, e.g., the base frame 210 (e.g., the outer surface of the base frame 210). A nut 230 is rotatably disposed on the jackscrew 220 (the nut 230 is housed in the second platform 120). When the jackscrew 220 is rotated in a first direction, the nut 230 moves in the direction of the second end 222 of the jackscrew 220 (e.g., toward the base frame 210). When the jackscrew 220 is rotated in a second direction, the nut 230 moves toward the first end 221 of the jackscrew (e.g., away from the base frame 210). In some embodiments, the system 100 further comprises a hand crank 229 removably attached to the jackscrew 220 (e.g., the first end 221 of the jackscrew 220). Jackscrews and hand cranks are well known to one of ordinary skill in the art.

The system 100 of the present invention utilizes height adjustment bars 420 (and sliding tracks 410) for raising and lowering the height of the first sides 111, 121 of the platforms 110, 120 (e.g. pivoting the first platform 110 with respect to the second platform 120). The height adjustment bars 420 are similar to the bars used in casement windows to extend the windows outwardly or in mechanisms for raising and lowering the heights of crib mattresses in cribs.

A first height adjustment bar 420*a* has a first end 421*a* and a second end 422*a* and a second height adjustment bar 420*b* has a first end 421*b* and a second end 422*b*. The first height adjustment bar 420*a* is pivotally attached to the second height adjustment bar 420*b* (e.g., the second end 422*a* of the first height adjustment bar 420*a* is pivotally attached to the first end 421*b* of the second height adjustment bar 420*b* via a first joint 430*a*). A first sliding track 410*a* is disposed in the inner surface 129*b* of the third side 113 of the first platform 110. A second sliding track 410*b* is disposed in the inner surface 129*c* of the third side 123 of the second platform 120.

The first end 421*a* of the first height adjustment bar 420*a* is pivotally attached to the inner surface of the third side 123 of the second platform 120 (the position of the first end 421*a* of the first height adjustment bar 420*a* is nearer to the first side 121 of the second platform 120 than is the second sliding track 410*b*). The first joint 430*a* is slidably disposed in the first sliding track 410*a*. The second end 422*b* of the second height adjustment bar 420*b* is slidably disposed in the second sliding track 410*b*. When the height adjustment bars 420 are pivoted toward each other (e.g., the second end 422*b* of the second height adjustment bar 420*b* slides within the second sliding track 410*b* toward the first end 421*a* of the first height adjustment bar 420*a*), the first joint 430*a* slides within the first sliding track 410*a* and pushes the first platform 110 upwardly, effectively raising the height of the first side 111 of the first platform 110. When the height adjustment bars 420 are pivoted away from each other (e.g., the second end 422*b* of the second height adjustment bar 420*b* slides within the second sliding track 410*b* away from the first end 421*a* of the first height adjustment bar 420*a*), the first joint 430*a* slides within the first sliding track 410*a* releasing upward pressure on the first platform 110, effectively lowering the height of the first side 111 of the first platform 110.

A third height adjustment bar 420*c* has a first end 421*c* and a second end 422*c* and a fourth height adjustment bar 420*d* has a first end 421*d* and a second end 422*d*. The third height adjustment bar 420*c* is pivotally attached to the fourth height adjustment bar 420*d* (e.g., the second end 422*c* of the third height adjustment bar 420*c* is pivotally attached to the first end 421*d* of the fourth height adjustment bar 420*d* via a second joint 430*b*). A third siding track 410*c* is disposed in the inner surface 129*d* of the fourth side 114 of the first platform 110. A fourth siding track 410*d* is disposed in the inner surface 129*e* of the fourth side 124 of the second platform 120.

The first end 421*c* of the third height adjustment bar 420*c* is pivotally attached to the inner surface of the fourth side 124 of the second platform 120 (the position of the first end 421*c* of the third height adjustment bar 420*c* is nearer to the first side 121 of the second platform 120 than is the fourth sliding track 410*d*).

The second joint 430*b* is slidably disposed in the third sliding track 410*c*. The second end 422*d* of the fourth height adjustment bar 420*d* is slidably disposed in the fourth sliding track 410*d*. When the height adjustment bars 420 are pivoted toward each other (e.g., the second end 422*d* of the fourth height adjustment bar 420*d* slides within the fourth sliding track 410*d* toward the first end 421*c* of the third height adjustment bar 420*c*), the second joint 430*b* slides within the third sliding track 410*c* and pushes the first platform 110 upwardly, effectively raising the height of the first side 111 of the first platform 110. When the height adjustment bars 420 are pivoted away from each other (e.g., the second end 422*d* of the fourth height adjustment bar 420*d* slides within the fourth sliding track 410*d* away from the first end 421*c* of the third height adjustment bar 420*c*), the second joint 430*b* slides within the third sliding track 410*c* releasing upward pressure on the first platform 110, effectively lowering the height of the first side 111 of the first platform 110.

A first spring line 240*a* (e.g., the first end 241*a* of the first spring line 240*a*) and a second spring line 240*b* (e.g., the first end 241*b* of the second spring line 240*b*) are attached to the nut 230. The second end 242*a* of the first spring line 240*a* is attached to the second end 422*b* of the second height adjustment bar 420*b*. The second end 242*b* of the second spring line 240*b* is attached to the second end 422*d* of the fourth height adjustment bar 420*d*.

In some embodiments, the first spring line 240*a* is fed through a series of pulleys, e.g., as shown in FIG. 5, a first pulley attached to the base frame 210, a second pulley attached to the inside surface of the first side 121 of the second platform (near the jackscrew), and a third pulley attached to the inside surface of the first side 121 of the second platform 120 near the third side 123 of the second platform 120. In some embodiments, the second spring line 240*b* is fed through a series of pulleys, e.g., as shown in FIG. 5, a fourth pulley attached to the base frame 210, a fifth pulley attached to the inside surface of the first side 121 of the second platform (near the jackscrew), and a sixth pulley attached to the inside surface of the first side 121 of the second platform 120 near the fourth side 124 of the second platform 120.

A first return spring 250*a* is attached to the inner surface 129*a* of the second side 122 of the second platform 120 near the third side 123 of the second platform 120. A second return spring 250*b* is attached to the inner surface 129*a* of the second side 122 of the second platform 120 near the fourth side 124 of the second platform 120. A third spring line 240*c* connects the first return spring 250*a* to the second end 422*b* of the second height adjustment bar 420*b*. A fourth spring line 240*d* connects the second return spring 250*b* to the second end 422*d* of the fourth height adjustment bar 420*d*.

The return springs 250 bias the first platform 110 downwardly (e.g., the return springs 250 pull the second ends 422 of the second height adjustment bar 420*b* and fourth height adjustment bar 420*b* toward the second end 122 of the second platform 120.

When the jackscrew is rotated in a first direction, the nut moves toward the first side 121 of the second platform 120. The nut pulls the first spring line and third spring line, which causes the second end 422*b* of the second height adjustment bar 420*b* to slide within the second sliding track 410*a* toward the first end 421*a* of the first height adjustment bar 420*a* and the second end 422*d* of the fourth height adjustment bar 420*d* to slide within the fourth sliding track 410*d* toward the first end 421*c* of the third height adjustment bar 420*c*. This causes the first joint 430*a* to slide within the first sliding track 410*a* and push upwardly on the first platform 110 and the second joint 430*b* to slide within the third sliding track 410*c* and push upwardly on the first platform 110.

When the jackscrew is rotated in a second direction, the nut moves away from the first side 121 of the second platform 120. Tension is released from the first spring line and third spring line, thus, the first return spring 250*a* pulls the second end 422*b* of the second height adjustment bar 420*b* toward the first return spring 250*a* and the second return spring 250*b* pulls the second end 422*d* of the fourth height adjustment bar 420*d* toward the second return spring. The first joint 430*a* slides within the first sliding track 410*a* and the second joint 430*b* slides within the third sliding track 410*c*, releasing upward pressure on the first platform 110, effectively lowering the height of the first side 111 of the first platform 110.

In some embodiments, a support bar 440 is connected to the first height adjustment bar 420*a* and to the first side 121 of the second platform 120. In some embodiments, a support bar 440 is connected to the third height adjustment bar 420*c* and to the first side 121 of the second platform 120.

As used herein, the term "about" refers to plus or minus 10% of the referenced number. For example, an embodiment wherein the jackscrew is about 10 inches in length includes a jackscrew that is between 9 and 11 inches in length.

The disclosures of the following U.S. Patents are incorporated in their entirety by reference herein: U.S. Design Pat. No. D267,739; U.S. Pat. No. 6,921,342; U.S. Pat. No. 7,758,444; U.S. Patent Application No 2007/0191128; U.S. Patent Application No. 2008/0274817; U.S. Patent Application No. 2010/0056289

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An adjustable golf surface system (100) comprising:

(a) a first platform (110) having a first side (111), a second side (112) opposite the first side (111), a third side (113), and a fourth side (114), and a second platform (120) having a first side (121), a second side (122) opposite the first side (121), a third side (123), and a fourth side (124), the first platform (110) is positioned over a top surface (125) of the second platform and a hinge (130) pivotally connects the second side (112) of the first platform (110) to the second side (122) of the second platform (120), wherein a golf surface (118) is disposed on a top surface (115) of the first platform (110), wherein a hollow base frame (210) is fixedly attached in the second platform (120);

(b) a base (140) and a base stud (150) extending upwardly from the base (140), wherein a bearing (178) is rotatably positioned on the base stud (150), a flange (160) extends outwardly from the bearing (178), and at least two springs (170) connect the flange (160) to the base frame (210);

(c) a jackscrew (220) having a first end (121) and a second end (222), the first end (121) protrudes through the first side (121) of the second platform (120) and the second end (222) is anchored to either the second side 122) of the second platform (120) or to the base frame (210), a nut (230) is rotatably disposed on the jackscrew (220);

(d) a first sliding track (410*a*) disposed in an inner surface (129*b*) of the third side (113) of the first platform (110) and a second sliding track (410*b*) disposed in an inner surface (129*c*) of the third side (123) of the second platform (120);

(e) a first height adjustment bar (420*a*) having a first end (421*a*) and a second end (422*a*), and a second height adjustment bar (420*b*) having a first end (421*b*) and a second end (422*b*), the second end (422*a*) of the first height adjustment bar (420*a*) is pivotally attached to the first end (421*b*) of the second height adjustment bar (420*b*) via a first joint (430*a*), the first end (421*a*) of the first height adjustment bar (420*a*) is pivotally attached to the inner surface (129*c*) of the third side (123) of the second platform (120) wherein the first end (421*a*) of the first height adjustment bar (420*a*) is positioned closer to the first side (121) of the second platform (120) than is the second sliding track (410*b*, the first joint (430*a*) is slidably disposed in the first sliding track (410*a*), and the second end (422*b*) of the second height adjustment bar (420*b*) is slidably disposed in the second sliding track (410*a*);

(f) a third siding track (410*c*) disposed in an inner surface (129*d*) of the fourth side (114) of the first platform (110) and a fourth sliding track (410*d*) disposed in an inner surface (129*e*) of the fourth side (124) of the second platform (120);

(g) a third height adjustment bar (420*c*) having a first end (421*c*) and a second end (422*c*), and a fourth height adjustment bar (420*d*) having a first end (421*d*) and a second, end (422*d*), the second end (422*c*) of the third height adjustment bar (420*c*) is pivotally attached to the first end (421*d*) of the fourth height adjustment bar (420*d*) via a second joint (430*b*), the first end (421*c*) of the third height adjustment bar (420*c*) is pivotally attached to the inner surface (129*e*) of the fourth side (124) of the second platform (120) wherein the first end (421*c*) of the third height adjustment bar (420*c*) is positioned closer to the first side (121) of the second platform (120) than is the fourth sliding track (410*d*), the second joint (430*b*) is slidably disposed in the third sliding track (410*c*), and the second end (422*d*) of the fourth height adjustment bar (420*d*) is slidably disposed in the fourth sliding track (410*d*);

(h) a first spring line (240*a*) having a first end (241*a*) attached to the nut (230) and a second end (242*a*) attached to the second end (422*b*) of the second height adjustment bar (420*b*), and a second spring line (240*b*) having a first end (241*b*) attached to the nut (230) and a second end (242*b*) attached to the second end (422*d*) of the fourth height adjustment bar (420*d*);

(i) a first return spring (250*a*) anchored to an inner surface (129*a*) of the second side (122) of the second platform (120) near the third side (123) of the second platform (120), and a second return spring (250*b*) anchored to the inner surface (129*a*) of the second side (122) of the platform (120) near the fourth side (124) of the second platform (120); and (j) a third spring line (240*c*) connecting the first return spring (250*a*) to the second end (422*b*) of the second height adjustment bar (420*b*) and a fourth spring line (240*d*) connecting the second return spring (250*b* to the second end (422*d*) of the fourth height adjustment bar (420*d*), the return springs (250) bias to pull the second ends (422) of the second height adjustment bar (420*b*) and fourth height adjustment bar (420*b*) toward the second end (122) of the second platform (120);

wherein when the jackscrew is rotated in a first direction, the nut moves toward the first side (121) of the second platform (120) and the nut pulls the first spring line and third spring line, which causes the second end (422*b*) of the second height adjustment bar (420*b*) to slide within the second sliding track (410*a*) toward the first end (421*a*) of the first height adjustment bar (420*a*) and the second end (422*d*) of the fourth height adjustment bar (420*d*) to slide within the fourth sliding track (410*d*) toward the first end (421*c*) of the third height adjustment bar (420*c*) causing the first joint (430*a*) to slide within the first sliding track (410*a*) and push upwardly on the first platform (110) and the second joint (430*b*) to slide within the third sliding track (410*c*) and push upwardly on the first platform (110);

wherein when the jackscrew is rotated in a second direction, the nut moves away from the first side (121) of the second platform (120) and tension is released from the first spring line and third spring line, and the first return spring (250*a*) pulls the second end (422*b*) of the second height adjustment bar (420*b*) toward the first return spring (250*a*) and the second return spring (250*b*) pulls the second end (422*d*) of the fourth height adjustment bar (420*d*) toward the second return spring, and the first joint (430*a*) slides within the first sliding track (410*a*) and the second joint (430*b*) slides within the third sliding track (410*c*), releasing upward pressure on the first platform (110), effectively lowering the height of the first side (111) of the first platform (110).

2. The system (100) of claim 1, wherein the platforms (110), (120) can spin in a first direction and a second direction about the base stud (150).

3. The system (100) of claim 1 further comprising a hand crank (229) removably attached to the first end (221) of the jackscrew (220).

4. The system (100) of claim 1, wherein the first spring line (240*a*) is fed through at least one pulley (260).

5. The system (100) of claim 1, wherein the second spring line (240*b*) is fed through at least one pulley (260).

* * * * *